US010087765B2

(12) United States Patent
Balliel et al.

(10) Patent No.: US 10,087,765 B2
(45) Date of Patent: Oct. 2, 2018

(54) ROTATING BLADE FOR A GAS TURBINE

(71) Applicant: Ansaldo Energia Switzerland AG, Baden (CH)

(72) Inventors: Martin Balliel, Bassersdorf (CH); Stefan Andreas Retzko, Zurich (CH); Frank Gersbach, Ehrendingen (CH); Igor Tsypkaykin, Turgi (CH); Julien Nussbaum, Battenheim (FR); Marco Lamminger, Ennetbaden (CH); Cornelia Santner, Untersiggenthal (CH)

(73) Assignee: ANSALDO ENERGIA SWITZERLAND AG, Baden (CH)

( * ) Notice: Subject to any disclaimer, the term of this patent is extended or adjusted under 35 U.S.C. 154(b) by 215 days.

(21) Appl. No.: 14/971,619

(22) Filed: Dec. 16, 2015

(65) Prior Publication Data

US 2016/0169006 A1 Jun. 16, 2016

(30) Foreign Application Priority Data

Dec. 16, 2014 (EP) ..... 14198315

(51) Int. Cl.
*F01D 5/20* (2006.01)
*F01D 5/14* (2006.01)
(Continued)

(52) U.S. Cl.
CPC ..... *F01D 5/20* (2013.01); *F01D 5/147* (2013.01); *F01D 5/187* (2013.01); *F01D 5/225* (2013.01);
(Continued)

(58) Field of Classification Search
CPC . F01D 5/20; F01D 5/225; F01D 5/147; F01D 5/187; F01D 25/08; F05D 2220/32;
(Continued)

(56) References Cited

U.S. PATENT DOCUMENTS 3,876,330 A * 4/1975 Pearson ..... F01D 5/18 415/115
5,531,568 A * 7/1996 Broadhead ..... F01D 5/186 415/115
(Continued)

FOREIGN PATENT DOCUMENTS

EP 1 890 008 A2 2/2008

OTHER PUBLICATIONS

European Search Report for EP 14198315.5 dated Jun. 19, 2015.

*Primary Examiner* — Richard Edgar
(74) *Attorney, Agent, or Firm* — Buchanan Ingersoll & Rooney PC

(57) ABSTRACT

A rotating blade for a gas turbine includes an airfoil extending in a longitudinal direction and having a leading edge and a trailing edge, whereby the airfoil is bordered at its outer end by a tip shroud, whereby the airfoil includes two or more internal passages, which run in longitudinal direction and are separated by solid webs, and whereby a plurality of shroud fins is arranged on top of the tip shroud to improve gas sealing against a corresponding stator heat shield. The stability and life time of the blade can be enhanced by selecting a position of each of the shroud fins to be exclusively above one of the webs and/or a leading edge wall.

5 Claims, 3 Drawing Sheets

(51) Int. Cl.
*F01D 5/18* (2006.01)
*F01D 25/08* (2006.01)
*F01D 5/22* (2006.01)

(52) U.S. Cl.
CPC ..... *F01D 25/08* (2013.01); *F05D 2220/32* (2013.01); *F05D 2240/307* (2013.01); *F05D 2260/22141* (2013.01); *F05D 2260/231* (2013.01); *F05D 2260/941* (2013.01)

(58) Field of Classification Search
CPC ..... F05D 2240/307; F05D 2260/22141; F05D 2260/231; F05D 2260/941
See application file for complete search history.

(56) References Cited

U.S. PATENT DOCUMENTS

| | | | | |
|---|---|---|---|---|
| 5,785,496 | A * | 7/1998 | Tomita | F01D 5/187 416/191 |
| 7,654,795 | B2 * | 2/2010 | Tibbott | F01D 5/187 415/115 |
| 8,317,472 | B1 * | 11/2012 | Liang | F01D 5/187 416/92 |
| 2007/0071593 | A1 | 3/2007 | Rathmann | |
| 2008/0025841 | A1 | 1/2008 | Norton et al. | |
| 2009/0081024 | A1 | 3/2009 | Tibbott | |
| 2012/0003078 | A1 * | 1/2012 | Pikul | F01D 5/225 415/173.1 |
| 2012/0107123 | A1 | 5/2012 | Schlemmer et al. | |

* cited by examiner

ROTATING BLADE FOR A GAS TURBINE

BACKGROUND OF THE INVENTION

The present invention relates to the technology of gas turbines and to a rotating blade for a gas turbine.

PRIOR ART

Rotating gas turbine blades with a tip shroud (used primarily to reduce over-tip leakage flow) normally use one or more fins to improve gas sealing against the corresponding stator heat shield and often are hollow with two or more internal passages within the airfoil (e.g. for cooling and/or weight reduction purposes).

During a casting process (usually investment casting using a ceramic mould and a ceramic core) these passages are produced by a core, which requires holding in position by so-called core exits, which connect the core to the mould and leave openings in the blade after removal of the core (usually by leaching and/or an abrasive/erosive process). Such openings in a blade are normally at the blade's root end (where cooling air may enter the blade's internal passages) and at the tip end, i.e. through the tip shroud, where they may interfere with any fins of the shroud and thereby compromise a fin's sealing function and mechanical stability.

Additionally, the fins have the largest distance from the rotational axis and therefore exert in conjunction with the mass of the tip shroud itself a relatively high centrifugal stress onto the tip end of the airfoil with local peak stresses at the base of the fins, which limits the life time of the tip shroud and the fins.

Small core exits at the tip compromise mechanical core stability (potential scrap at casting, potential reduction in wall thickness control), may require a more complex cooling design and manufacture for an airfoil trailing edge (TE) and/or pressure side (PS) release of cooling medium, and may reduce life time caused by additional notches generated by the airfoil TE and/or PS release of cooling medium.

A potential countermeasure is to cool or additionally cool the tip shroud and fins to improve mechanical properties of the materials, but this consumes cooling air, which reduces turbine efficiency and power, and may not be readily possible due to other constraints (cooling air delivery to the required area, complexity, and cost).

An alternative potential countermeasure is to eliminate or significantly reduce the size of a blade's tip shroud. However, this will cause an over-tip leakage, which reduces turbine efficiency and power.

SUMMARY OF THE INVENTION

It is an object of the present invention to provide a rotating blade for a gas turbine, which avoids the drawbacks of known blades and has an improved stability and life time without sacrificing turbine efficiency.

A rotating blade for a gas turbine, comprises: an airfoil extending in a longitudinal direction and having a leading edge and a trailing edge, whereby said airfoil is bordered at its outer end by a tip shroud, whereby said airfoil includes two or more internal passages, which run in the longitudinal direction and are separated by solid webs, each having first and second longitudinal ends, each longitudinal end being attached to walls defining the internal passages, and whereby a plurality of shroud fins is arranged on top of said tip shroud to improve gas sealing against a corresponding stator heat shield, wherein a base of each said shroud fins is selected to be exclusively located directly above one of said webs and/or a leading edge wall.

According to an embodiment of the invention most of said shroud fins are straight, i.e. aligned with the longitudinal axis of said blade, in order to avoid a reduction of space for core exits provided in said tip shroud.

Specifically, a shroud fin provided at the leading edge of said blade has an inclination towards said leading edge in order to achieve good sealing against the corresponding stator heat shield.

According to another embodiment of the invention, on an upper surface of said tip shroud between said shroud fins one or more stiffener fins are provided to increase the stiffness of said tip shroud for reduction of mechanical stress and radial clearances.

Specifically, said airfoil has a camber line, and said stiffener fins are oriented perpendicular to said airfoil camber line.

Also, said stiffener fins may have a variable height to provide maximum stiffness with minimum weight to improve mechanical stability against tip shroud bending due to the centrifugal force.

According to a further embodiment of the invention, on an upper surface of said tip shroud and behind a shroud fin provided at the leading edge of said blade, one or more small fins are provided to increase the heat transfer to the colder surrounding medium for increased cooling of a floor of said tip shroud.

Specifically, said small fins are aligned with the rotating direction of the blade to minimise a breaking effect and improve the mechanical stability of tip shroud against bending upwards due to the centrifugal force.

BRIEF DESCRIPTION OF THE DRAWINGS

The present invention is now to be explained more closely by means of different embodiments and with reference to the attached drawings.

DETAILED DESCRIPTION OF DIFFERENT EMBODIMENTS OF THE INVENTION

Figure 1:
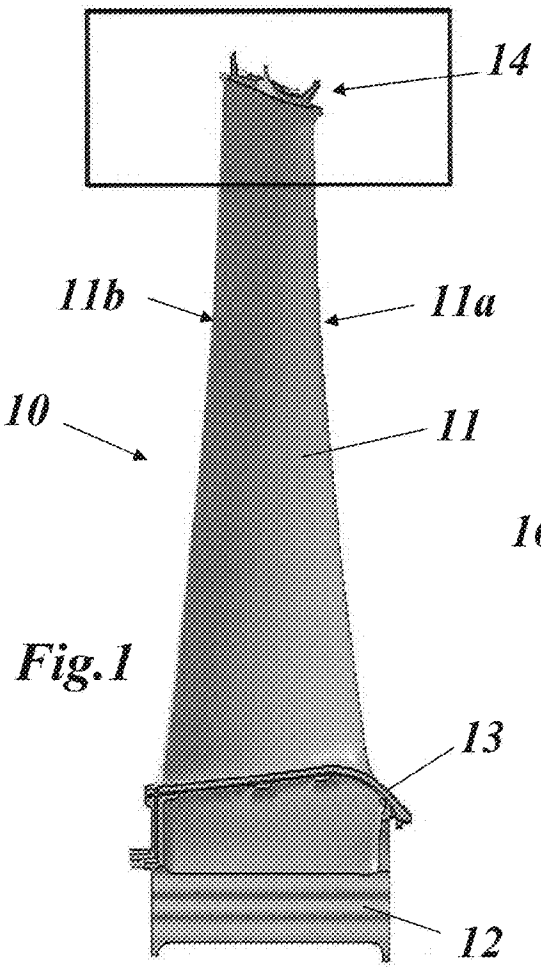
FIG. 1 is a side view of a rotating blade of a gas turbine according to an embodiment of the invention.
Figure 3:
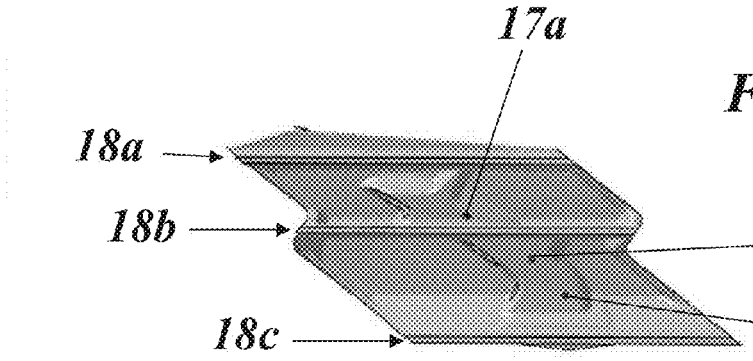
FIG. 3 is a top view on the tip shroud of the blade according to FIG. 1.

FIG. 1 is a side view of a rotating blade 10 of a gas turbine according to an embodiment of the invention. Blade 10 comprises an airfoil 11 extending in a longitudinal direction (radial with regard to the machine axis). At the inner end, the aerodynamical section of airfoil 11 is bordered by an (inner) platform 13, which is part of the inner boundary of the hot gas channel of the gas turbine. Below platform 13 there is a blade root 12 for fixing blade 10 on the rotor of the machine. Relative to the axial hot gas flow, airfoil 11 has a leading edge 11*a* and a trailing edge 11*b*. Furthermore, it has a curved cross section profile and thus a convex side (suction side) and a concave side (pressure side).

Figure 2:
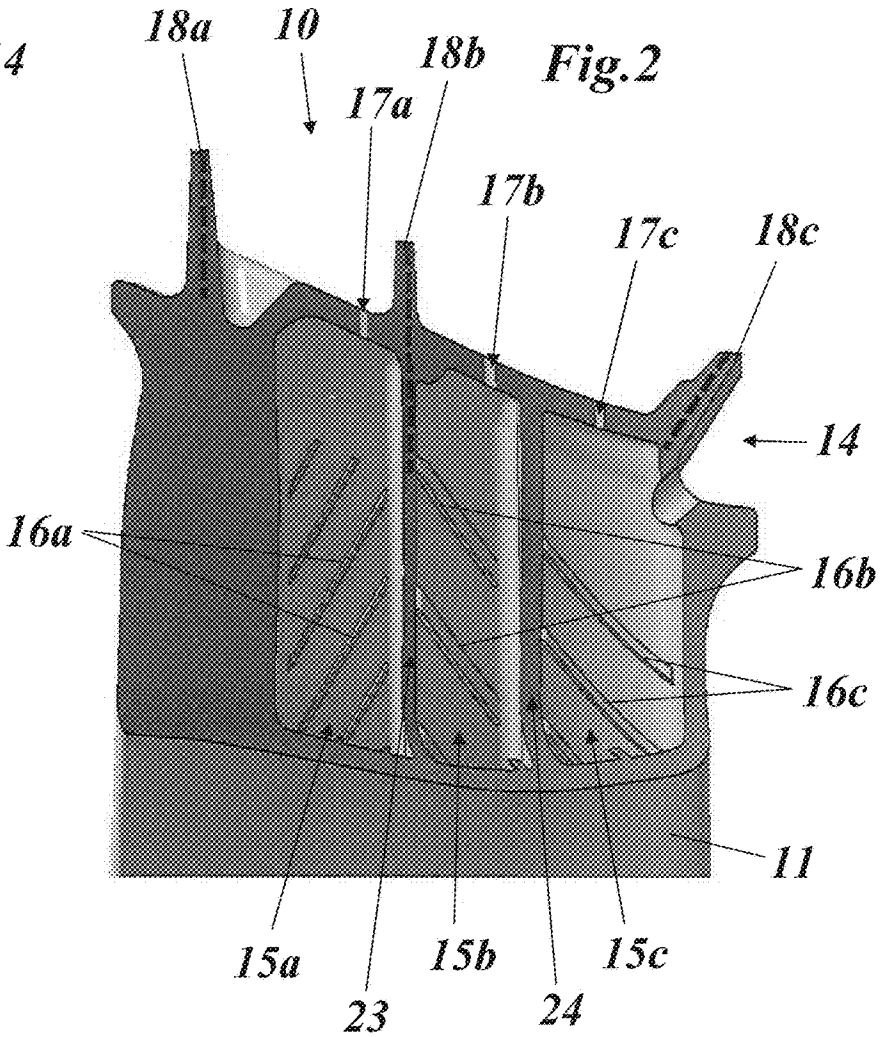
FIG. 2 is a longitudinal section through the upper part of the blade according to FIG. 1.

At the outer end, the aerodynamical section of airfoil 11 is bordered by a tip shroud 14, which is shown in more detail in FIG. 2.

Through the interior of airfoil 11 run in longitudinal direction two or more internal passages 15*a*, 15*b* and 15*b*, which are used to cool blade 10 by means of a cooling medium (e.g. cooling air). Heat transfer between the walls of airfoil 11 and the cooling medium is improved by providing ribs 16*a*, 16*b* and 16*c* on the walls of inner passages 15*a*, 15*b* and 15*b*. Inner passages 15*a*, 15*b* and 15*b* are separated by so-called solid webs 23 and 24.

Three shroud fins 18*a*, 18*b* and 18*c* are arranged on top of tip shroud 14. Shroud fins 18*a*, 18*b* and 18*c* are each part of a circumferential ring, which is composed of respective shroud fins of all blades of one turbine stage. These rings are used to improve gas sealing against the corresponding stator heat shield.

For tip shroud 14 of rotating gas turbine blade 10 with two or more internal passages 15*a*, 15*b* and 15*c*, which are separated by solid webs 23 and 24, the position and inclination of shroud fins 18*a*, 18*b* and 18*c* are selected to be above any webs 23, 24 or the leading edge wall (shroud fin 18*c*), but not above an internal passage 15*a*, 15*b* or 15*c*.

This selection provides increased space for core exits 17*a*, 17*b* and 17*c* (a core is used to produce the internal passages during a casting process and requires holding in position by so-called core exits, which connect the core to the mould) through the tip shroud 14 without interference with the shroud fins 18*a*, 18*b* and 18*c*, and improves life time of the shroud 14, as shroud fins 18*a*, 18*b* and 18*c*, which are primarily centrifugally loaded, are mechanically better supported by the solid webs 23, 24 or solid airfoil directly below and thereby in line with the centrifugal load due to the shroud fins.

Additionally, an inclination of shroud fin 18*c* towards the airfoil's leading edge (LE) 11*a* (see dashed line) achieves good sealing against the corresponding stator heat shield (as the differential in gas pressure across the LE fin 18*c* is larger than for any other subsequent fin), while other shroud fins 18*b* or 18*a* in the middle (fin 18*b*) or towards the trailing edge (TE) 11*b* (fin 18*a*) are straight (i.e. aligned with the blade's longitudinal axis; see dashed lines), thereby avoiding a reduction of space for core exits 17*a*, 17*b* and 17*c*.

Furthermore, rotating gas turbine blades 10 with a tip shroud 14 (used primarily to reduce over-tip leakage flow) often require increased fillets underneath of the shroud or increase of the shroud platform thickness to ensure the shroud stiffness and life time. However, increase of the fillet could lead to additional aerodynamic losses and the platform thickness increase leads to significant shroud weight increase and is not very efficient for stiffness improvement.

Figure 4:
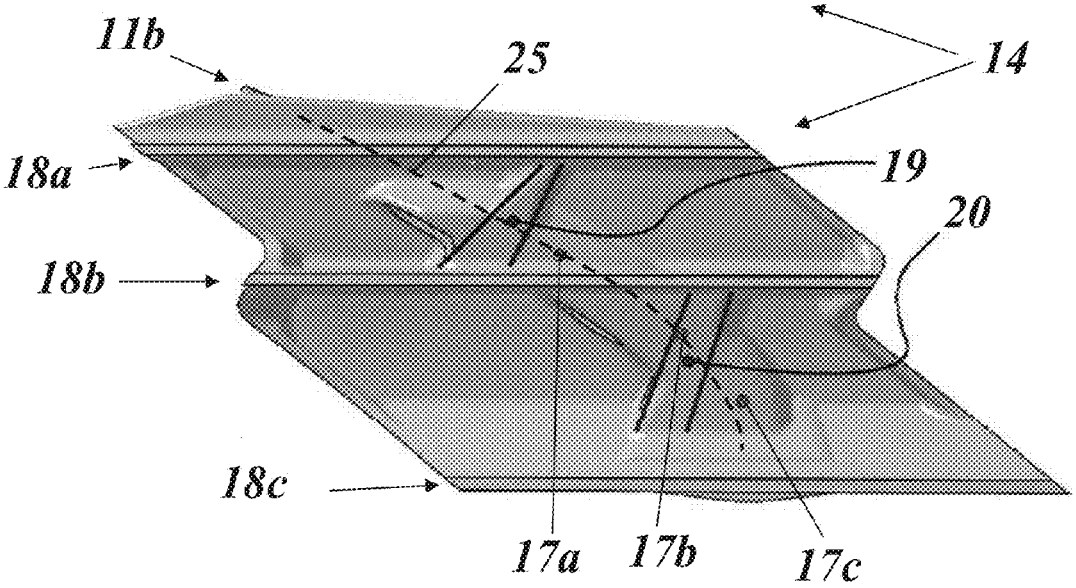
FIG. 4 is a top view on the tip shroud of the blade according to FIG. 1 showing additional stiffening features according to another embodiment of the invention.

Thus, for a rotating gas turbine blade 10 with a tip shroud 14, on the upper surface of the shroud between the shroud fins 18*a*, 18*b* and 18*c*, one or more stiffener fins 19 and 20 are provided to increase the stiffness of the shroud for reduction of mechanical stress and radial clearances, which in turn extends the blade's life time and the turbine performance (see FIG. 4). Stiffener fins 19, 20 are perpendicular to the airfoil camber line 25 and have variable height to provide maximum stiffness with minimum weight to improve mechanical stability against tip shroud bending due to the centrifugal force.

Furthermore, rotating gas turbine blades 10 with a tip shroud 14 often require cooling of tip shroud 14 to ensure the life time. However, cooling in particular of the outer portions of a shroud towards (concave) pressure side (PS) or (convex) suction side (SS) is difficult, as potential design solutions are complex and expensive to manufacture, and/or cause additional notches which locally intensify stress and thereby limit life time.

Figure 5:
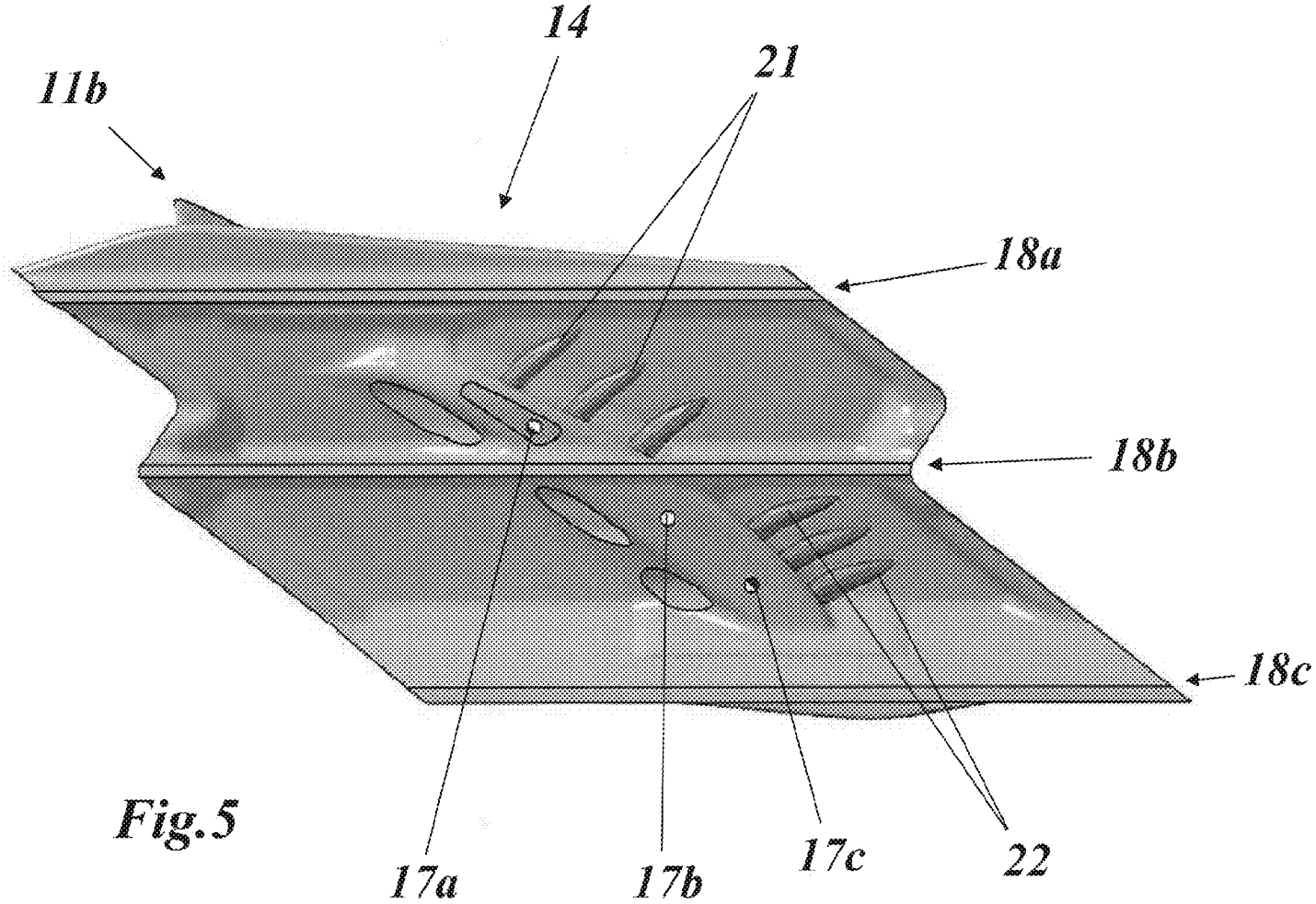
FIG. 5 is a top view on the tip shroud of the blade according to FIG. 1 showing additional cooling features according to a further embodiment of the invention.

Thus, for a rotating gas turbine blade 10 with a tip shroud 14, on the upper surface of the shroud and behind shroud fin 18*c* towards the blade's leading edge (LE) 11*a* one or more small fins 21, 22 are provided to increase the heat transfer to the colder surrounding medium (mixture of cooling medium and hot gas above tip shroud 14) for increased cooling of the tip shroud's floor, which in turn extends the blade's lifetime due to improved mechanical properties of the shroud material (see FIG. 5).

Small fins 21, 22 are preferably aligned with the rotating direction of the blade to minimise a breaking effect, which might reduce the gas turbine's efficiency and power, and additionally to improve the mechanical stability of tip shroud 14 against bending upwards due to the centrifugal force. As the small fins 21, 22 are positive material on the upper surface of the shroud; they do not introduce any significant local notches.

LIST OF REFERENCE NUMERALS

10 blade (gas turbine GT)
11 airfoil
11*a* leading edge
11*b* trailing edge
12 root
13 platform
14 tip shroud
15*a*, 15*b*, 15*c* internal passage
16*a*, 16*b*, 16*c* rib
17*a*, 17*b*, 17*c* core exit
18*a*, 18*b*, 18*c* shroud fin
19, 20 stiffener fin
21, 22 fin (small)
23, 24 solid web
25 camber line

The invention claimed is:

1. A rotating blade for a gas turbine, comprising:

an airfoil extending in a longitudinal direction and having a leading edge and a trailing edge, whereby said airfoil is bordered at its outer end by a tip shroud, whereby said airfoil includes two or more internal passages, which run in the longitudinal direction and are separated by solid webs, and whereby a plurality of shroud fins is arranged on top of said tip shroud to improve gas sealing against a corresponding stator heat shield, wherein a position of each of said shroud fins is selected to be exclusively above one of said webs and/or a leading edge wall, wherein most of said shroud fins are straight, aligned with the longitudinal axis of said blade, in order to avoid a reduction of space for core exits provided in said tip shroud, and wherein a shroud fin provided at the leading edge of said blade has an inclination towards said leading edge in order to achieve good sealing against the corresponding stator heat shield.

2. The rotating blade as claimed in claim 1, comprising:

one or more stiffener fins provided on an upper surface of said tip shroud between said shroud fins to increase a stiffness of said tip shroud for reduction of mechanical stress and radial clearances.

3. The rotating blade as claimed in claim 2, wherein said airfoil has a camber line, and said stiffener fins are oriented perpendicular to said airfoil camber line.

4. The rotating blade as claimed in claim 1, wherein on an upper surface of said tip shroud and behind a shroud fin provided at the leading edge of said blade one or more small fins are provided to increase heat transfer to a colder surrounding medium for increased cooling of a floor of said tip shroud when in operation.

5. The rotating blade as claimed in claim 4, wherein said small fins are aligned with a rotation direction of the blade to minimise a breaking effect and improve mechanical stability of tip shroud against bending upwards due to centrifugal force when in operation.

* * * * *